US007114914B2

(12) United States Patent
Gendraud et al.

(10) Patent No.: US 7,114,914 B2
(45) Date of Patent: Oct. 3, 2006

(54) DEVICE FOR CONTROLLING CLEARANCE IN A GAS TURBINE

(75) Inventors: Alain Gendraud, Vernou la Celle (FR); Delphine Roussin, Antony (FR); David Audeon, Massy (FR)

(73) Assignee: Snecma Moteurs, Paris (FR)

( * ) Notice: Subject to any disclaimer, the term of this patent is extended or adjusted under 35 U.S.C. 154(b) by 109 days.

(21) Appl. No.: 10/895,857

(22) Filed: Jul. 22, 2004

(65) Prior Publication Data

US 2005/0042080 A1 Feb. 24, 2005

(30) Foreign Application Priority Data

Aug. 6, 2003 (FR) ..... 03 09686

(51) Int. Cl.
*F01D 11/24* (2006.01)

(52) U.S. Cl. ..... 415/108; 415/116; 415/173.2

(58) Field of Classification Search ..... 415/173.1, 415/173.2, 108, 116
See application file for complete search history.

(56) References Cited

U.S. PATENT DOCUMENTS 4,337,016 A * 6/1982 Chaplin ..... 415/116
5,281,085 A * 1/1994 Lenahan et al. ..... 415/116
6,035,929 A 3/2000 Friedel et al.

FOREIGN PATENT DOCUMENTS

DE 39 09 369 A1 10/1989
EP 0 541 325 A1 5/1993
GB 2217788 A * 11/1989

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

A device for controlling the clearance between the tips of rotary blades and a stationary ring assembly of a gas turbine, the device comprising a circular control box having at least two annular air circulation strips that are spaced apart from each other in the axial direction, each having a plurality of perforations in order to modify the temperature of the stationary ring assembly by discharging air, an annular air feed channel radially spaced from the air circulation strip, at least one air duct for feeding the feed channel with air, and a plurality of hollow distribution spacers connecting the air feed channel to the air circulation strips in order to feed the strips with air while enabling the air that has been discharged against the stationary ring assembly to flow between the feed channel and the circulation strips in order to be evacuated therefrom.

20 Claims, 3 Drawing Sheets

DEVICE FOR CONTROLLING CLEARANCE IN A GAS TURBINE

BACKGROUND OF THE INVENTION

The present invention relates to the general field of controlling clearance in a gas turbine between the tips of rotary blades and a stationary ring assembly.

A gas turbine, e.g. a high-pressure turbine of a turbomachine, typically has a plurality of stationary vanes alternating with a plurality of moving blades in a passage for hot gas coming from the combustion chamber of the turbomachine. The moving blades of the turbine are surrounded over the entire circumference of the turbine by a stationary ring assembly. The stationary ring assembly defines the flow steam of hot gas through the blades of the turbine.

In order to increase the efficiency of such a turbine, it is known to reduce to as small as possible the clearance that exists between the tips of the moving blades of the turbine and the facing portions of the stationary ring assembly. In order to do this, means have been devised that serve to vary the diameter of the stationary ring assembly. Such means are generally in the form of annular ducts surrounding the stationary ring assembly and conveying air taken from other portions of the turbomachine. This air is injected against the outside surface of the stationary ring assembly facing away from the stream of hot gas, thereby causing the stationary ring assembly to expand or contract thermally so as to vary its diameter. In general, this thermal expansion or contraction is controlled, depending on the operating speed of the gas turbine, by means of a valve which serves to control the flow rate and the temperature of the air fed to the ducts. The assembly constituted by the ducts and the valve thus forms a box for controlling clearance at the tips of the blades.

Prior art control boxes do not always enable great uniformity of temperature to be obtained over the entire circumference of the stationary ring assembly. A lack of temperature uniformity leads to distortions in the stationary ring assembly which are particularly harmful to the efficiency and the lifetime of the gas turbine.

Furthermore, the air from control boxes that has been injected against the outside surface of the stationary ring assembly needs to be exhausted to the outside. This exhausting of air must be capable of taking place without significantly disturbing the flow of air which is injected against the outside surface of the stationary ring assembly. Nevertheless, in prior art control boxes, it is found that the air that is to be exhausted generally tends to disturb the flow of the air that has been injected, thereby reducing the effectiveness of the box for controlling clearance at the tips of the blades.

OBJECT AND SUMMARY OF THE INVENTION

The present invention thus seeks to mitigate such drawbacks by proposing a clearance control device which makes it possible to obtain a highly uniform temperature for the stationary ring assembly while avoiding disturbances between air that is to be exhausted and air that is to be injected.

To this end, the invention provides a device for controlling clearance between the tips of rotary blades and a stationary ring assembly in a gas turbine, said device comprising a circular control box surrounding said stationary ring assembly, wherein said control box comprises: at least two annular air circulation strips spaced apart from each other in the axial direction and each having a plurality of perforations for modifying the temperature of the stationary ring assembly by discharging air; an annular air feed channel radially spaced from said air circulation strip; at least one air duct for feeding said feed channel with air; and a plurality of hollow distribution spacers connecting said air feed channel to said air circulation strips in order to feed the strips with air while allowing the air that has been discharged against the stationary ring assembly to flow between said feed channel and said circulation strips in order to be exhausted therefrom.

The radial spacing between the feed channel and the air circulation strips of the control box thus provides a gap for exhausting the air that has been discharged against the stationary ring assembly. As a result, the air which has been discharged is exhausted radially and does not disturb the flow of air being discharged against the stationary ring assembly.

This radial spacing also makes it possible to avoid any exchange of heat between the feed channel and the air circulation strips of the control box, thereby improving the effectiveness of the clearance control device.

Preferably, the stationary ring assembly comprises an inner casing which is surrounded by an outer casing of the gas turbine so as to define an annular chamber in which said control box is mounted.

The control box may bear in leaktight manner at an upstream axial end against the outer casing, and at a downstream axial end against the inner casing so as to define, inside the angular chamber, an air discharge upstream enclosure and an air exhaust downstream enclosure that is airtight relative to the upstream enclosure.

The disposition, number, and hole diameter of the hollow distribution spacers can be used to adjust the flow rate of air feeding the air circulation strips, and can thus be used to ensure that the temperature of the stationary ring assembly is uniform.

In particular, the distribution spacers connecting the feed channel to one of the air circulation strips may be in angular alignment with or they may be angularly offset relative to the distribution spacers of other air circulation strips, and the angular spacing between two successive distribution spacers preferably does not exceed about 45°.

BRIEF DESCRIPTION OF THE DRAWINGS

Other characteristics and advantages of the present invention appear from the following description made with reference to the accompanying drawings which show an embodiment that is not limiting in any way. In the figures.

DETAILED DESCRIPTION OF AN EMBODIMENT

Figure 1:
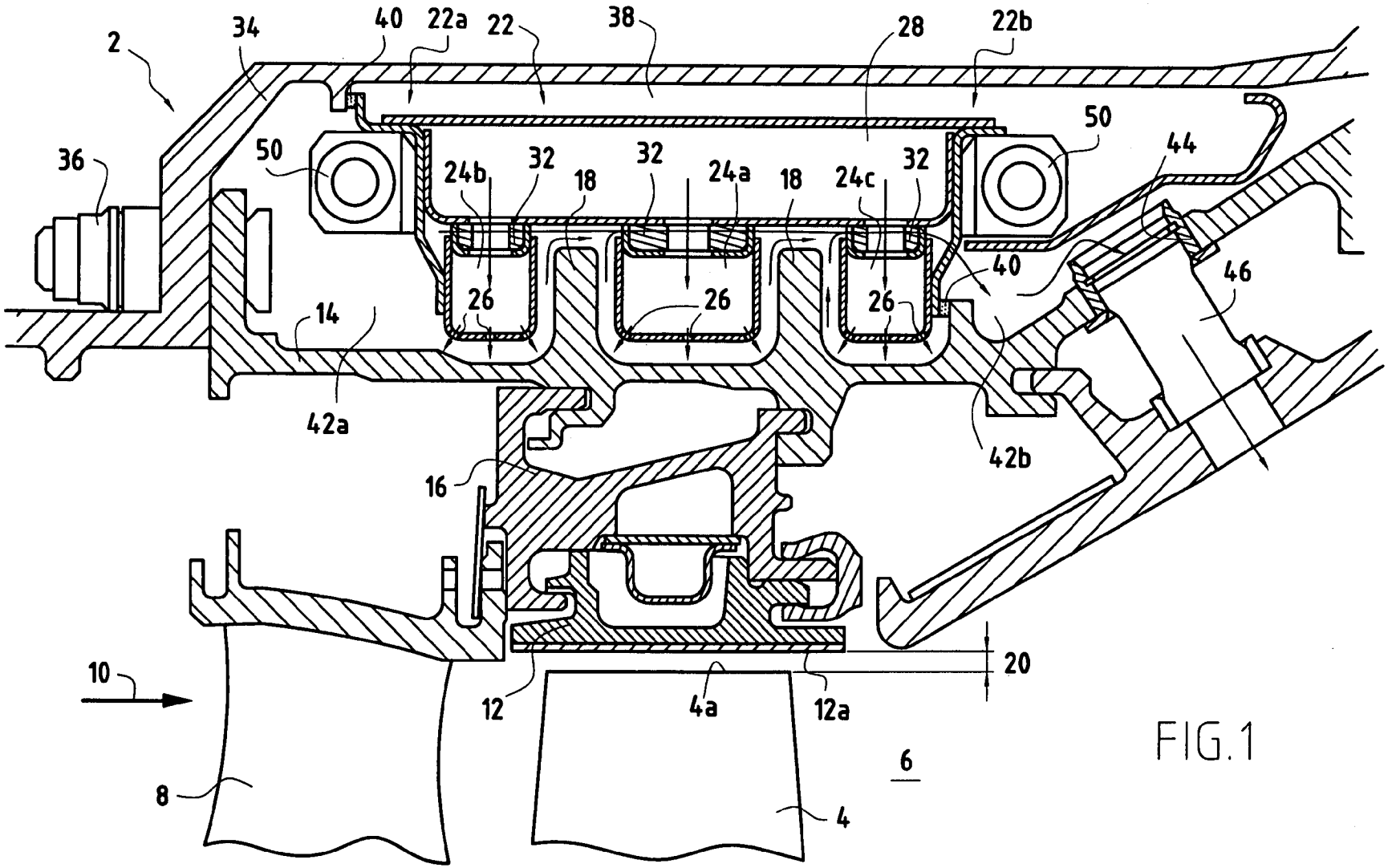
FIG. 1 is a longitudinal section view of a clearance control device of the invention.

FIG. 1 is a longitudinal section view of a high-pressure turbine 2 of a turbomachine fitted with a clearance control device of the invention. Nevertheless, the present invention could equally be applied to a low-pressure turbine of a turbomachine or to any other type of machine fitted with a clearance control device.

The high-pressure turbine 2 is made up in particular of a plurality of moving blades 4 disposed in a flow passage 6 for hot gas coming from a combustion chamber (not shown) of the turbomachine. These moving blades 4 are disposed downstream from stationary vanes 8 of the turbine in the flow direction 10 of the hot gas in the passage 6.

The moving blades 4 of the high-pressure turbine 2 are surrounded by a plurality of stationary ring segments 12 disposed circumferentially around the axis of the turbine so as to form a surface that is circular and continuous. These ring segments 12 are mounted on an inner casing 14 of the turbomachine via a plurality of spacers 16. In the description below, the assembly formed by the stationary ring segments 12, the inner casing 14, and the spacers 16 is referred to by the term "stationary ring assembly".

The inner casing 14 of the stationary ring assembly is provided with annular fins or projections 18 of disk shape extending in a radial direction. The main function of these fins 18 is to act as a heat exchanger. In FIG. 1, there are two such fins 18. Nevertheless, it will be possible to have some larger number of fins.

The stationary ring segments 12 have respective inside surfaces 12*a* that are directly in contact with the hot gas and that define part of the flow passage 6 for the hot gas.

A radial gap is left between the inside surface 12*a* of each ring segment 12 and the tips 4*a* of the moving blade 4 of the turbine to allow the blades to rotate. This radial gap thus defines clearance 20 which should be made as small as possible so as to increase the efficiency of the turbine.

In order to reduce the clearance 20 at the tips of the moving blades 4, a clearance control device is provided in the form of a circular control box 22 surrounding the stationary ring assembly, and more precisely surrounding the inner casing 14.

Depending on the operating speeds of the turbomachine, the control box 22 serves either to cool or to heat the fins 18 of the inner casing 14 by discharge (or impact) of air thereagainst. Under the effect of this discharge of air, the inner casing 14 retracts or expands, thereby reducing or increasing the diameter of the stationary ring segments 12 of the turbine.

In the invention, the control box 22 of the clearance control device has at least two annular air circulation strips 24 surrounding the inner casing 14 of the stationary ring assembly.

Each of the air circulation strips 24 has a plurality of perforations 26 for discharging air against the fins 18 of the inner casing 14. In the embodiment of FIG. 1, the perforations 26 in each strip 24 are in the form of three rows of perforations.

In FIG. 1, the strips 18 of the inner casing 14 are two in number such that the control box 22 has three air circulation strips 24 that are spaced apart from one another in the axial direction: a central strip 24*a* disposed between the two fins 18, and both an upstream strip 24*b*, and a downstream strip 24*c*, disposed respectively upstream and downstream relative to the central strip 24*a*.

Advantageously, the air circulation strips 24 match approximately the shape of the fins 18. Specifically, each of them presents a right section that is substantially rectangular.

The control box 22 also comprises an annular air feed channel 28 to supply air to the air circulation strips 24. The air feed channel 28 surrounds the circular strips 24.

In addition, at least one air duct 30 (FIGS. 3A and 3B) opens out into the feed channel 28 in order to feed it with air. The air flowing in the air duct 30 is taken from other portions of the turbomachine. For example, this air may be taken from one or more stages of the high- or low-pressure compressors of the turbomachine, or from its fan.

Air is taken under the control of a control valve (not shown) which enables air at cooler or hotter temperature to be fed to the control box 22 depending on the operation speed of the turbomachine.

The air feed channel 28 and the air circulation strips 24 are spaced apart in the radial direction and are interconnected by a plurality of hollow distribution spacers 32.

The hollow distribution spacers 32 feed air to the circulation strips 24 while allowing the air that has been discharged against the fins 18 of the inner casing 14 to flow axially between the air feed channel 28 and the air circulation strips 24 so as to be exhausted therefrom.

Figure 2:
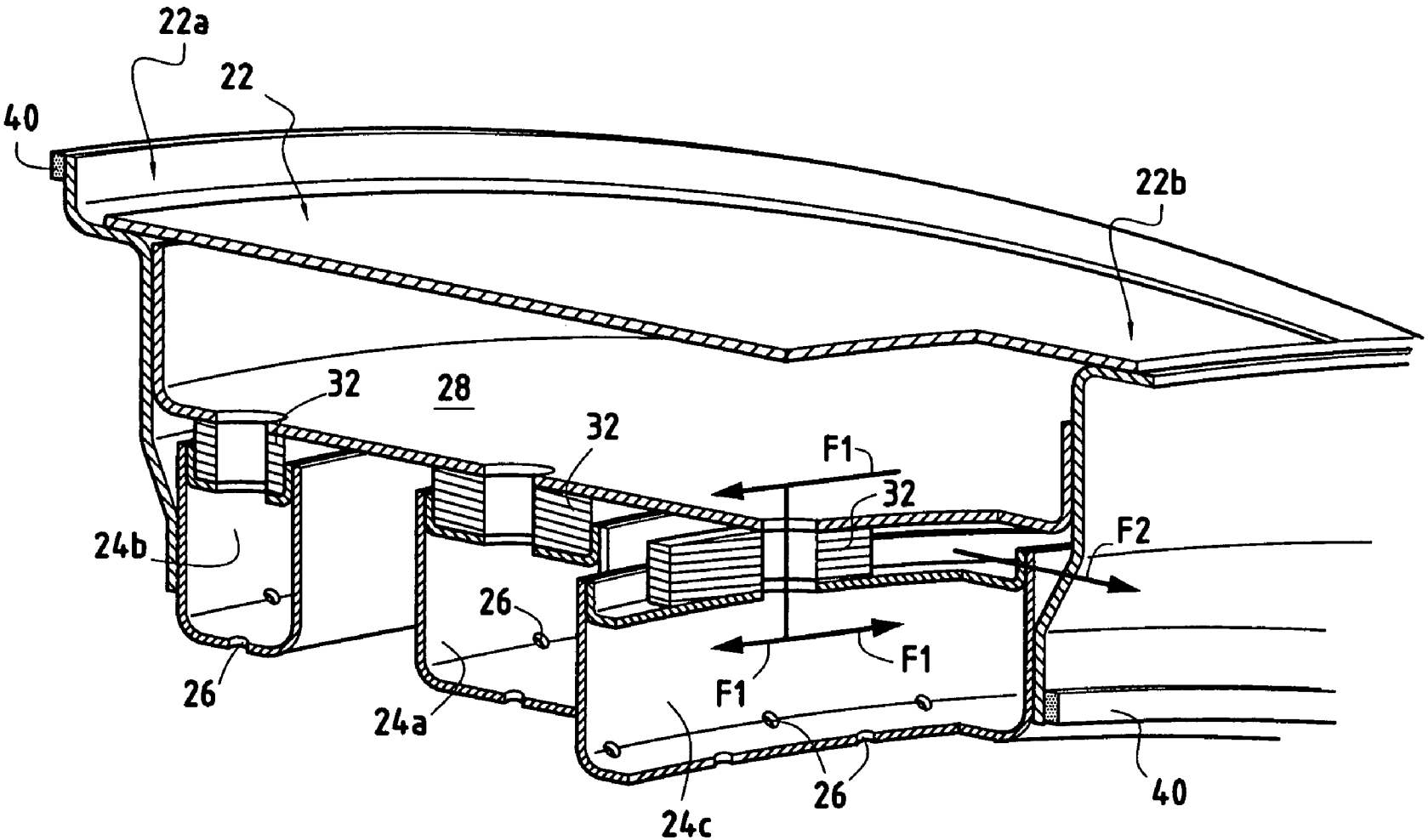
FIG. 2 is a cutaway fragmentary perspective view of the FIG. 1 clearance control device.

FIG. 2 shows more clearly the path followed by air that is to be exhausted. In this figure, arrows F1 represent the tangential air flow directions in the feed channels 28 and in the air circulation strips 24, while arrow F2 shows the axial air flow direction of air that has been discharged against the fins of the inner casing.

As a result, the air that has been discharged against the fins 18 of the inner casing 14 does not disturb the flow of air passing through the perorations 26 in the air circulation strips 24. This particular disposition serves to improve the effectiveness of the device for controlling the clearance 20 at the tips of the moving blades 4 of the turbine.

In order to ensure that the air which has been discharged against the fins 18 is indeed exhausted by flowing axially between the air feed channel 28 and the air circulation strips 24, the turbine 2 is advantageously provided with an outer casing 34 surrounding the inner casing 14 of the stationary ring assembly. At an axially upstream end, the outer casing 34 is secured to the inner casing 14 by a screw-and-nut type fastener 36.

Between them, the inner and outer casings 14 and 34 define an annular chamber 38 in which the control box 22 of the clearance control device of the invention is mounted. More precisely, the control box 22 has an axially upstream end 22*a* bearing against the outer casing 34, and an axially downstream end 22*b* bearing against the inner casing 14. The downstream and upstream ends 22*a* and 22*b* of the control box 22 preferably bear in leaktight manner against the casings via sealing gaskets 40.

The particular disposition of the control box 22 relative to the inner and outer casings 14 and 34 thus makes it possible to define, inside the annular chamber 38, an "air discharge" upstream enclosure 42*a* and an "air exhaust" downstream enclosure 42*b* which is air-tight relative to the upstream enclosure 42*a*.

Thus, air which has been discharged from the air circulation strips 24, and in particular the upstream strip 24*b* is confined in the air discharge upstream enclosure 42*a* and can be exhausted only by flowing between the feed channel 28 and the circulation strips 24. The sealing achieved at the upstream end 22*a* of the control box 22 prevents the air from going round the control box 22 in order to be exhausted. Similarly, air which has been discharged from the downstream strip 24*c* is constrained, by the sealing achieved at the downstream end 22*b* of the control box 22, to flow between the feed channel 28 and the circulation strips 24 to be evacuated.

As shown in FIG. 1, the air which has been discharged against the fins 18 of the inner casing 14 and which is exhausted between the feed channel 28 and the circulation strips 24 is then confined in the air exhaust downstream enclosure 42*b*.

Preferably, the inner casing 14 presents an opening 44 at a downstream axial end that opens out into the air exhaust downstream enclosure 42*b* in order to exhaust the air which is confined therein. This opening 44 may be provided with a bushing 46 and serves to exhaust the air which has been discharged against the fins 18 of the inner casing, e.g. for the purpose of feeding the first stage of a low-pressure nozzle (not shown) of the turbomachine.

Two possible configurations of the clearance control device of the invention are described below with reference more particularly to FIGS. 3A and 3B.

Figure 3A:
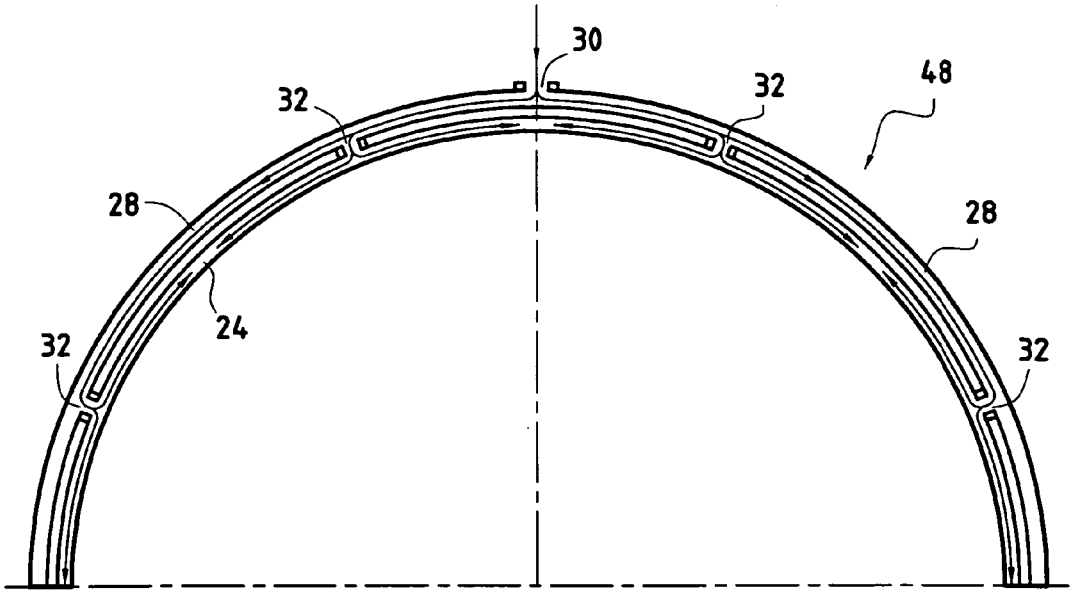
FIGS. 3A and 3B are fragmentary cross-section views showing two possible configurations of the clearance control device of the invention.
Figure 3B:
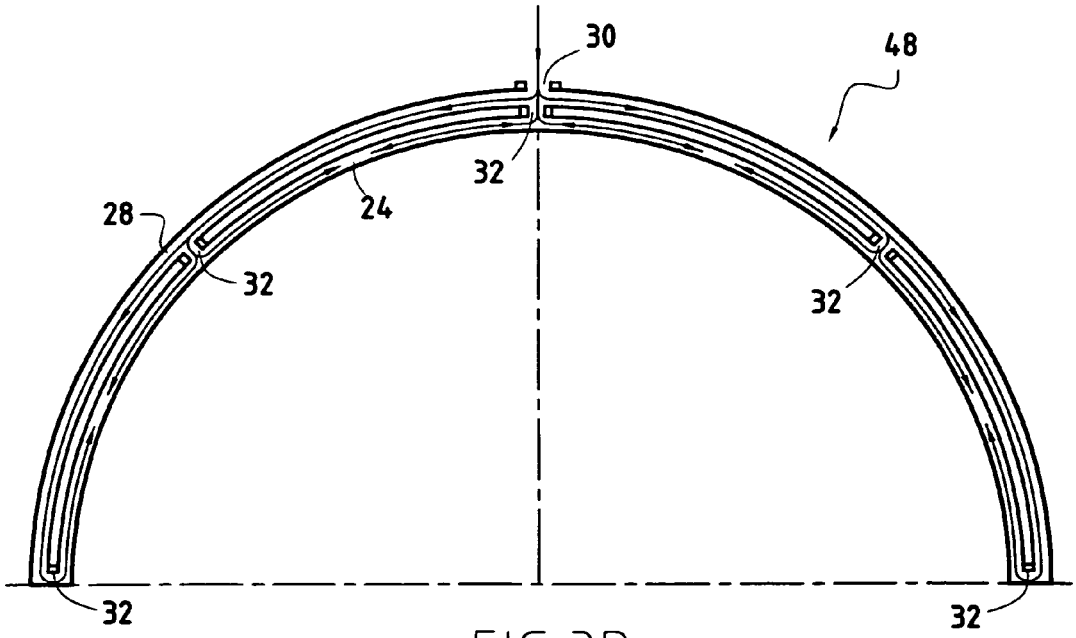

In these two configurations, the control box comprises two distinct angular box sectors 48 (or half-boxes of 180° each), only one of which is shown in FIGS. 3A and 3B. These two box sectors 48 are secured to each other by screw-and-nut type fasteners which cooperate with orifices 50 (FIG. 1) disposed at each angular end of the box sectors.

It would also be possible to devise a control box made up of more than two distinct angular box sectors, suitable when placed end to end to build up a box covering 360°.

The box sectors 48 shown in FIGS. 3A and 3B are closed at each angular end, such that air cannot flow from one box sector to another. Nevertheless, it is also possible to provide connections between the box sectors in order to allow air to flow from one box sector to another.

Each box sector 48 is itself fed by a single air duct 30 opening out into the feed channel 28 at a point halfway between the two angular ends of the box sector. The air duct could also open out into one of the angular ends of the box sector. It is also possible to envisage having a plurality of air ducts.

In FIG. 3A, provision is made for each box sector 48 to have four hollow distribution spacers 32 connecting the feed channel 28 to the circulation strip 24 that is shown. These hollow distribution spacers 32 are disposed around the half-circumference of the box sector 48 in such a manner that the angular distance between two successive spacers preferably does not exceed about 45°.

In FIG. 3B, five hollow distribution spacers 32 connect the feed channel 28 to the circulation strip 24 that is shown. More particularly, a distribution spacer is disposed at each angular end of the box sector and the angular distance between two successive spacers preferably does not exceed about 45°.

It should be observed that in both of these two configurations, the air which penetrates into each circulation strip 24 via each of the hollow distribution spacers 32 flows in two opposite tangential directions.

It should also be observed that the number and the distribution of the hollow distribution spacers can vary between the air circulation strips belonging to the same box sector.

Thus, for a given box sector, the hollow distribution spacers connecting the feed channel to one of the air circulation strips can be angularly offset relative to the hollow distribution spacers connecting the feed channel to at least one other one of the air circulation strips.

Angularly offsetting the hollow distribution spacers between the air circulation strips makes it possible to obtain better temperature uniformity within the control box, thereby avoiding any distortion of the stationary ring assembly.

Such an angular offset can be obtained, for example, in a single box sector that has free air circulation strips as shown in FIGS. 1 and 2. In this example, the central strip 24*a* (or conversely the upstream and downstream strips 24*b* and 24*b*) can have the configuration shown in FIG. 3A, while the upstream and downstream strips 24*b* and 24*c* (or conversely the central strip 24*a*) can have the configuration of FIG. 3B.

For the three strips 24*a*, 24*b*, and 24*c*, such a disposition corresponds to a staggered disposition of the distribution spacers 32 with the dispositions of the upstream and downstream strips 24*b* and 24*c* being symmetrical. Such symmetrical dispositions make it possible to obtain thermal expansion or contraction that are substantially identical between the two fins 18 of the inner casing 14 so as to improve the uniformity of temperature over the stationary ring assembly.

Alternatively, the hollow distribution spacers connecting the feed channel of a given box sector to one of the air circulation strips can be in angular alignment with the hollow distribution spacers connecting the feed channel to the other air circulation strips.

Still in the circumstance of a single box sector having three air circulation strips 24*a*, 24*b*, and 24*c*, as shown in FIGS. 1 and 2, an angular alignment of the hollow distribution spacers can be obtained by giving the three air circulation strips the same configuration. In this example, the configuration of the three air circulation strips can be identical to that of FIG. 3A or to that of FIG. 3B.

It is also possible to envisage feeding each air circulation strip of a given box sector with air via a single hollow distribution spacer connected to the feed channel. In addition, if the single distribution spacer is disposed at one angular end of the box sector, the flow of air in the strip will take place in a single tangential direction.

The diameter of the hole in each hollow distribution spacer may differ from one spacer to another in a given air circulation strip. Varying the diameter of the distribution spacers also makes it possible to control the flow rate of air fed to the strip depending on the angular location of the spacer for the purpose of improving temperature uniformity of the stationary ring assembly.

In general, and as a function of requirements, the number, the hold diameter, and the disposition of the distribution spacers can vary over a given circulation strip and for a given box sector. These various parameters are selected in such a manner as to minimize distortion of the stationary ring assembly.

What is claimed is:

1. A device for controlling clearance between the tips of rotary blades and a stationary ring assembly in a gas turbine, said device comprising a circular control box surrounding said stationary ring assembly, wherein said control box comprises:

at least two annular air circulation strips spaced apart from each other in the axial direction and each having a plurality of perforations for modifying the temperature of the stationary ring assembly by discharging air;

an annular air feed channel radially spaced from said air circulation strip;

at least one air duct for feeding said feed channel with air; and a plurality of hollow distribution spacers connecting said air feed channel to said air circulation strips in order to feed the strips with air while allowing the air that has been discharged against the stationary ring assembly to flow between said feed channel and said circulation strips in order to be exhausted therefrom.

2. A device according to claim 1, wherein the stationary ring assembly comprises an inner casing which is surrounded by an outer casing of the gas turbine so as to define an annular chamber in which said control box is mounted.

3. A device according to claim 2, wherein said control box bears in leaktight manner at an upstream axial end against the outer casing, and at a downstream axial end against the inner casing so as to define, inside said angular chamber, an air discharge upstream enclosure and an air exhaust downstream enclosure that is air-tight relative to said upstream enclosure.

4. A device according to claim 3, wherein said inner casing presents an air opening at a downstream axial end, opening out into the air exhaust downstream enclosure in order to exhaust the air that has been discharged against the stationary ring assembly.

5. A device according to claim 2, wherein the inner casing includes annular fins, and wherein the air circulation strips match substantially the shape of said fins.

6. A device according to claim 1, wherein said control box is made up of at least two distinct angular box sectors.

7. A device according to claim 1, wherein the hollow distribution spacers connecting the feed channel to one of the air circulation strips are angularly offset relative to the hollow distribution spacers connecting said feed channel to at least one of the other air circulation strips.

8. A device according to claim 1, wherein the hollow distribution spacers connecting the feed channel to one of the air circulation strips are angularly aligned relative to the hollow distribution spacers connecting said feed channel with the other air circulation strips.

9. A device according to claim 1, wherein the angular spacing between two successive hollow distribution spacers does not exceed about 45°.

10. A turbomachine including a device according to claim 1.

11. A device for controlling clearance between the tips of rotary blades and a stationary ring assembly in a gas turbine, said device comprising a circular control box surrounding said stationary ring assembly, said control box comprising:

at least two annular air circulation strips spaced apart from each other in the axial direction and each having a plurality of perforations for modifying the temperature of the stationary ring assembly by discharging air;

an annular air feed channel radially spaced from said air circulation strip;

at least one air duct for feeding said feed channel with air; and a plurality of spacing means for connecting said air feed channel to said air circulation strips in order to feed the strips with air while allowing the air that has been discharged against the stationary ring assembly to flow between said feed channel and said circulation strips in order to be exhausted therefrom.

12. A device according to claim 11, wherein the stationary ring assembly comprises an inner casing which is surrounded by an outer casing of the gas turbine so as to define an annular chamber in which said control box is mounted.

13. A device according to claim 12, wherein said control box bears in leaktight manner at an upstream axial end against the outer casing, and at a downstream axial end against the inner casing so as to define, inside said angular chamber, an air discharge upstream enclosure and an air exhaust downstream enclosure that is air-tight relative to said upstream enclosure.

14. A device according to claim 13, wherein said inner casing presents an air opening at a downstream axial end, opening out into the air exhaust downstream enclosure in order to exhaust the air that has been discharged against the stationary ring assembly.

15. A device according to claim 12, wherein the inner casing includes annular fins, and wherein the air circulation strips match substantially the shape of said fins.

16. A device according to claim 11, wherein said control box is made up of at least two distinct angular box sectors.

17. A device according to claim 11, wherein the spacing means connecting the feed channel to one of the air circulation strips are angularly offset relative to the spacing means connecting said feed channel to at least one of the other air circulation strips.

18. A device according to claim 11, wherein the spacing means connecting the feed channel to one of the air circulation strips are angularly aligned relative to the spacing means connecting said feed channel with the other air circulation strips.

19. A device according to claim 11, wherein the angular spacing between two successive spacing means does not exceed about 45°.

20. A turbomachine including a device according to claim 11.

* * * * *